US008466770B2

(12) United States Patent
Richardson

(10) Patent No.: US 8,466,770 B2
(45) Date of Patent: Jun. 18, 2013

(54) MULTI-TORROID TRANSFORMER

(75) Inventor: Robert Richardson, Chelmsford (GB)

(73) Assignee: E2V Technologies (UK) Limited, Chelmsford (GB)

( * ) Notice: Subject to any disclaimer, the term of this patent is extended or adjusted under 35 U.S.C. 154(b) by 155 days.

(21) Appl. No.: 13/056,920

(22) PCT Filed: Jul. 29, 2009

(86) PCT No.: PCT/GB2009/050942

§ 371 (c)(1), (2), (4) Date: Mar. 15, 2011

(87) PCT Pub. No.: WO2010/013049

PCT Pub. Date: Feb. 4, 2010

(65) Prior Publication Data

US 2011/0164441 A1 Jul. 7, 2011

(30) Foreign Application Priority Data

Jul. 31, 2008 (GB) ..... 0813986.7

(51) Int. Cl.
*H01F 27/28* (2006.01)

(52) U.S. Cl.
USPC ..... 336/229

(58) Field of Classification Search
USPC ..... 336/225, 229, 180–184
See application file for complete search history.

(56) References Cited

U.S. PATENT DOCUMENTS

| | | | | |
|---|---|---|---|---|
| 4,117,437 | A * | 9/1978 | Ottesen | 336/69 |
| 4,338,657 | A | 7/1982 | Lisin et al. | |
| 4,777,406 | A | 10/1988 | Ross et al. | |
| 4,807,105 | A | 2/1989 | Varjasi et al. | |
| 5,023,768 | A | 6/1991 | Collier | |
| 5,307,040 | A * | 4/1994 | Lytollis | 336/73 |
| 5,805,431 | A | 9/1998 | Joshi et al. | |
| 6,377,153 | B1 | 4/2002 | Yamanaka et al. | |

FOREIGN PATENT DOCUMENTS

| | | |
|---|---|---|
| EP | 0429315 | 5/1991 |
| EP | 0490438 | 6/1992 |
| EP | 1071103 | 1/2001 |
| EP | 1085536 | 3/2001 |
| GB | 427948 | 5/1935 |
| GB | 2308924 | 7/1997 |
| GB | 2447963 A | 10/2008 |
| JP | 11-176678 | 7/1999 |
| SU | 756572 A1 | 12/1975 |
| WO | WO-2008/065234 | 6/2008 |

OTHER PUBLICATIONS

United Kingdom Search Report of GB0813986.7 dated Oct. 10, 2008.

International Search Report for PCT/GB2009/050942 Dated Jan. 14, 2010.

* cited by examiner

*Primary Examiner* — Tuyen Nguyen

(74) *Attorney, Agent, or Firm* — Venable LLP; Robert Kinberg

(57) ABSTRACT

A transformer comprises a secondary winding including a plurality of coaxially arranged toroidal closed magnetic circuits connected in series within an enclosure and a primary winding comprising a plurality of turns including electrically conducting members passing axially through the toroidal closed magnetic circuits, respective ones of the plurality of electrically conducting members being electrically connected by respective electrically conducting strip lines passing along walls of the enclosure to form the continuous primary winding.

20 Claims, 8 Drawing Sheets

MULTI-TORROID TRANSFORMER

CROSS-REFERENCE TO RELATED APPLICATION

The present application is a National Stage of International Application No. PCT/GB2009/050942, filed Jul. 29, 2009, designating the United States and claiming priority to Great Britain Application No. GB 0813986.7, Jul. 31, 2008.

BACKGROUND OF THE INVENTION

This invention relates to a multi-toroid transformer.

Referring to FIGS. 1*a* and 1*b*, high frequency, high voltage transformers 101, 102 are known from GB 0706197.1 which have multiple toroids 11, 12 for both primary and secondary circuit functions numbered 1 to $N_{pc}$ and 1 to $N_{sc}$ respectively. A single turn tube 13 links these primary and secondary toroid groups. FIGS. 1*a* and 1*b* show a circuit diagram and a schematic drawing of such transformers respectively.

As power and/or operating requirements are increased a voltage $V_{loop}$ on the single turn 13 can become sufficiently high that the primary core set 11 numbered 1 to $N_{pc}$ can be dispensed with if $V_{loop}$ is a suitable voltage to connect directly to a power supply circuit output.

At a lower voltage it may also be possible to eliminate the set of primary closed magnetic circuits by making the loop more than a single turn. There is in fact no limit, in theory, to a number of turns that could be wound on the secondary core set so that the loop turns themselves match a required power supply voltage.

JP 11 176678 discloses a high voltage transformer comprising a plurality of modules connected in series each module comprising a transformer structure and a voltage amplification and rectifier circuit. The transformers of the modules are driven by a single turn primary winding which is apparently connected directly to a power supply.

GB 427,948 discloses a transformer with concentric single first and second windings on respective magnetic cores enclosed in a casing with a central post extending coaxially through the magnetic cores of the first and second windings such that the post and casing act as a secondary winding for the first winding and as a primary winding for the second winding, i.e. the post and casing form a common coupling winding.

U.S. Pat. No. 5,023,768 discloses a cylindrical tank with an axial hollow core such that secondary windings can be accommodated in the tank coaxial with the tank core. In one embodiment, multiple turns of insulated wire pass through the core and around an outer wall and end faces of the tank to form a primary winding. Alternatively, a single turn primary winding is formed from metal layers on the tank core, tank ends and outer walls.

U.S. Pat. No. 6,377,153 discloses a transformer for use in insulated switching power supply apparatus with a reduction of switching noise, in which cores are electrically connected by an electrically conductive housing which operates as a single-turn winding.

SUMMARY OF THE INVENTION

According to a first aspect of the present invention there is provided a transformer comprising secondary winding means including a plurality of coaxially arranged toroidal closed magnetic circuit means connected in series within an enclosure means and primary winding means comprising a plurality of turns including electrically conducting members passing axially through the toroidal closed magnetic circuit means, respective ones of the plurality of the electrically conducting members being connected by respective electrically conducting strip line means passing along walls of the enclosure means to form a continuous electrical conductor as the primary winding means.

Conveniently, the electrically conducting members are mutually spaced apart such that cross-sections of the conducting members lie substantially on a circumference of a circle on a transverse cross-section of the enclosure means.

Advantageously, the electrically conducting members are at least one of tubes, rods and strip conductors.

Conveniently, the electrically conducting members are tubes with a wall thickness comparable to a skin depth of the electric current carried thereby at an operating frequency of the transformer.

Optionally, the electrically conducting members are flat strip conductors of thickness comparable to a skin depth of the electric current carried thereby at an operating frequency of the transformer.

Optionally, the electrically conducting members comprise a combination of electrically conducting members connected in parallel, each conducting member with a wall thickness comparable to a skin depth of the electric current carried thereby at an operating frequency of the transformer.

Conveniently, the electrically conducting strip line means are formed in printed circuit boards located on outer faces of walls of the enclosure means.

Conveniently, the enclosure has a substantially rectilinear transverse cross-section and the walls of the enclosure parallel to a longitudinal axis of the enclosure are substantially planar.

Conveniently, the electrically conducting strip line means are located on first, second and third walls of the substantially planar walls and have a thickness greater than a skin depth at an operating frequency of the transformer.

Advantageously, a fourth substantially planar wall comprises a printed circuit board for rectifying components.

Conveniently, the transformer further comprises insulating tube means on which the secondary toroidal closed magnetic circuit means are located and arranged to provide voltage hold off for the electrically conducting members passing axially through the toroidal closed magnetic circuits.

Conveniently, the transformer further comprises coolant distribution means.

Advantageously, the coolant distribution means comprises tube means, coaxial with, and of a smaller diameter than core apertures of the toroidal closed magnetic circuit means, the tube means being supplied with bleed hole apertures to direct the coolant towards respective secondary toroids.

Conveniently, the transformer further comprises electrostatic screen means between the primary winding means and secondary winding means.

Advantageously, the electrostatic screen means is provided by a thin-walled metallic sleeve located between the primary winding means and the secondary winding means.

Advantageously, the thin-walled metallic sleeve comprises a longitudinal slit to minimise eddy currents in the thin-walled metallic sleeve.

Conveniently, the transformer further comprises electrically insulating sheet means located between the toroidal closed magnetic circuit means and inner walls of the enclosure to provide high voltage insulation and minimize a risk of a high voltage tracking across a surface of the insulator.

Conveniently, the individual secondary toroidal closed magnetic circuit means are interconnected such that each secondary toroidal closed magnetic circuit means of the transformer is star connected and provides an input to a two pulse rectifier.

According to a second aspect of the invention, there is provided a three-phase inverter system, comprising three individual and isolated transformers as described above, wherein the primary winding means of the transformers are delta connected and arranged to be fed from a three-phase inverter.

Advantageously, the secondary toroidal closed magnetic circuit means of the three individual and isolated transformers are interconnected such that each secondary toroidal closed magnetic circuit means of a transformer is star connected and provides an input to a six pulse rectifier.

BRIEF DESCRIPTION OF THE DRAWINGS

The invention will now be described, by way of example, with reference to the accompanying drawings in which.

DETAILED DESCRIPTION

Figure 1A:
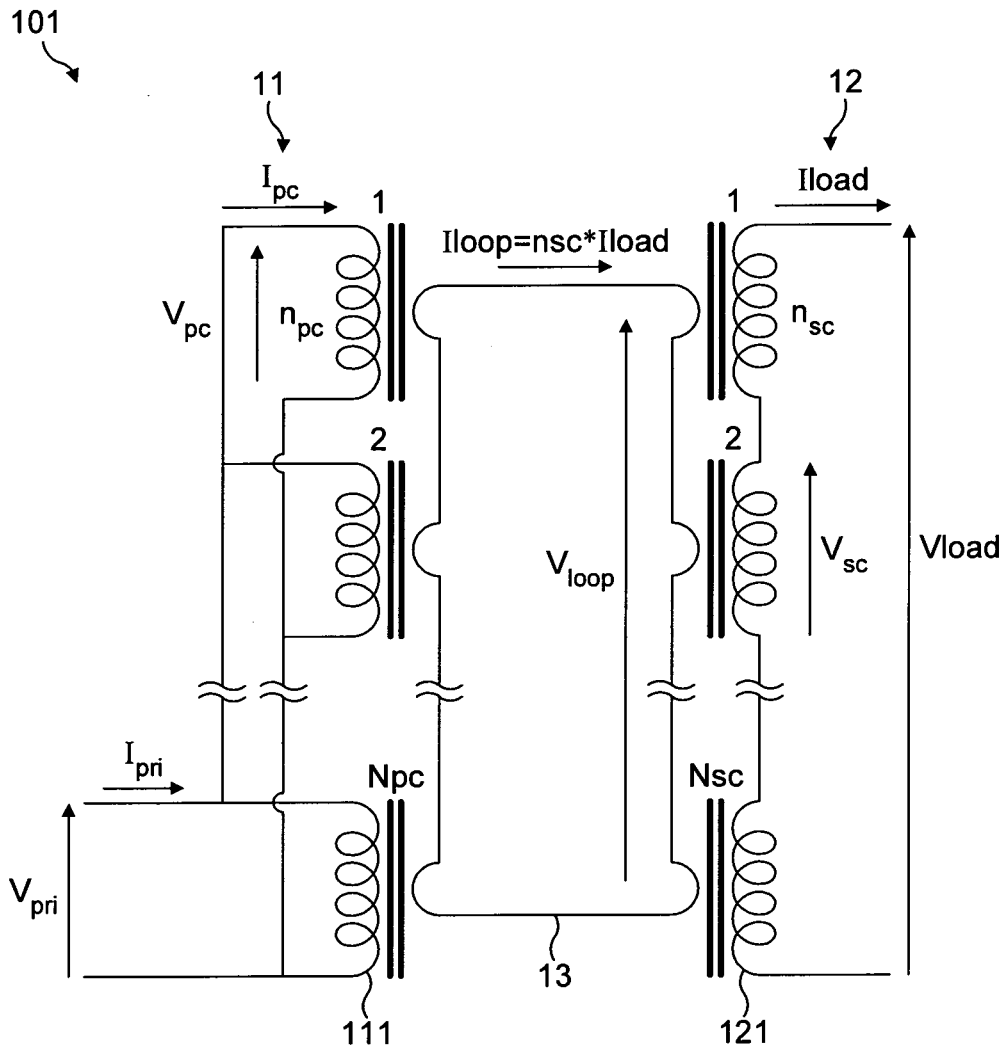
FIG. 1a PRIOR ART
FIG. 1*a* is a circuit diagram of a first prior art transformer.

In the Figures like reference numerals denote like parts. It will be understood that in the interests of clarity the drawings are not necessarily to scale.

Figure 1B:
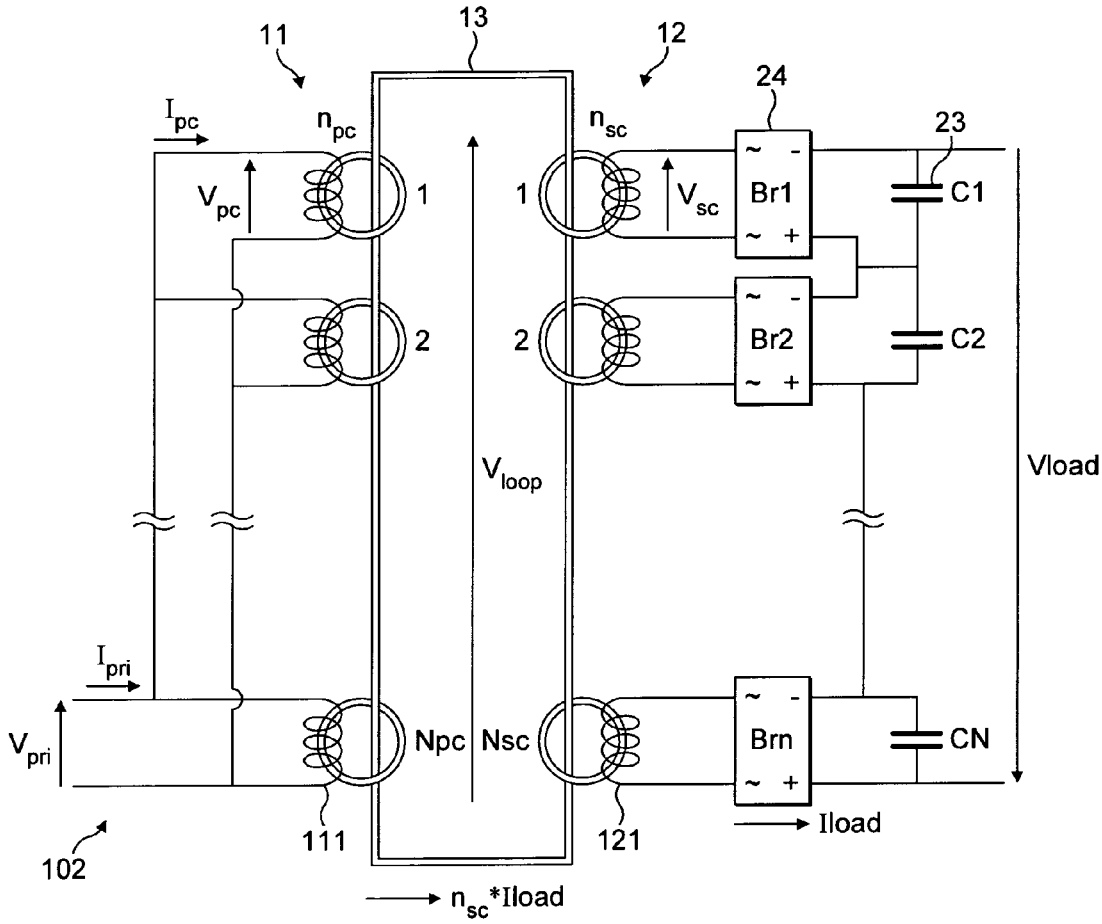
FIG. 1b PRIOR ART
FIG. 1*b* is a schematic drawing of a second prior art transformer.
Figure 2:
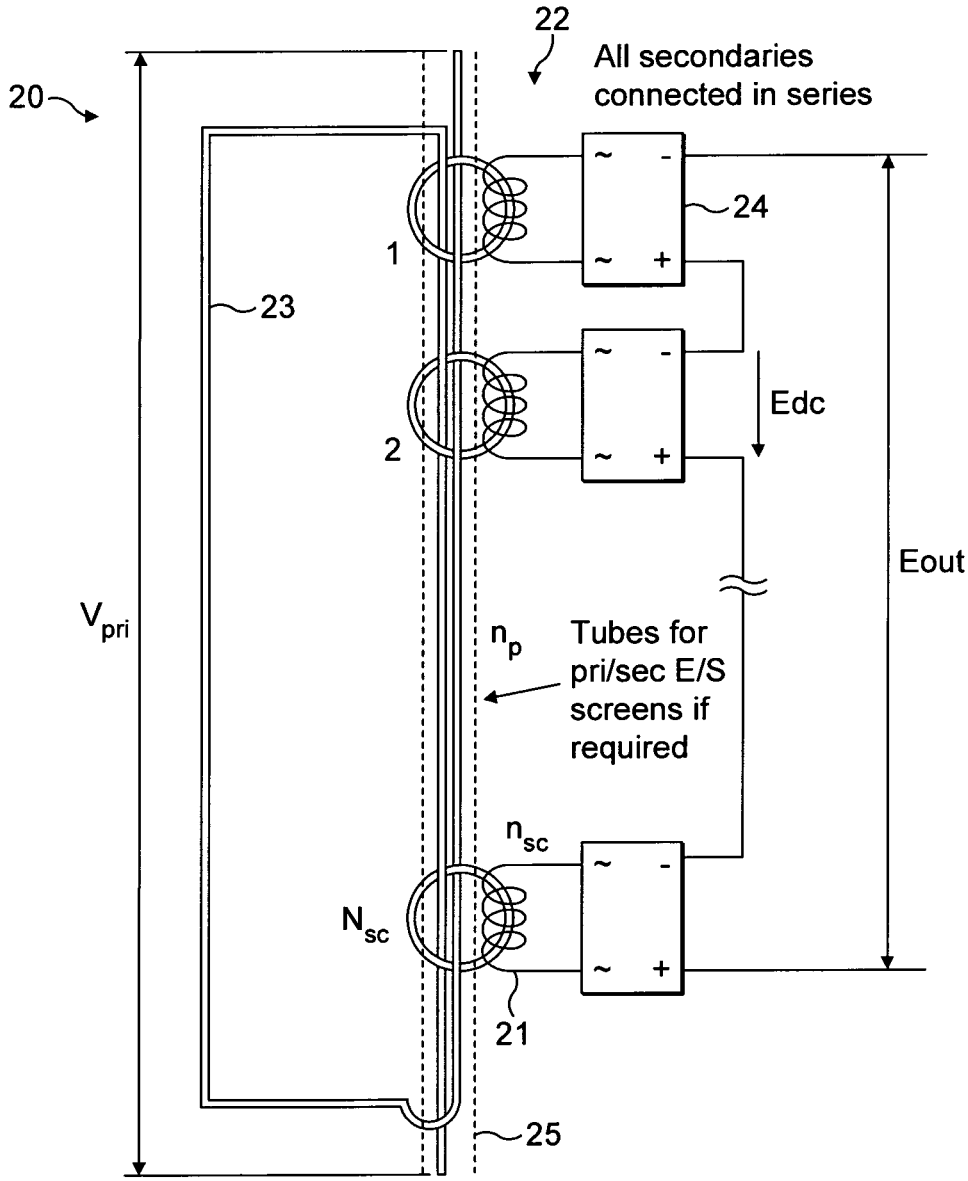
FIG. 2 is a schematic drawing of a first embodiment of a transformer according to the invention.

FIG. 2 shows an embodiment of the invention similar to the transformer of FIG. 1*b* but without the primary toroids. Thus referring to a basic circuit of a transformer 20 according to the invention in FIG. 2, the secondary winding 22 comprises a plurality $N_{sc}$ of closed magnetic circuits 1 to $N_{sc}$, which are connected in series, each of which has a number $n_{sc}$ of turns 21.

All the secondary magnetic circuits are electromagnetically coupled to a low resistance loop 23 having two turns passing through the secondary closed magnetic circuits but otherwise comprising a single loop. Thus the primary effectively has two turns but any reasonable number $n_p$ of turns could be used.

Each of the $N_{sc}$ secondary windings 21 is provided with a respective rectifier 24, so that an output of the transformer 20 may be rectified to provide a DC output Eout.

The section of the primary turning through the secondary magnetic circuits may be located within tubing 25 to provide electrostatic screening between the primary winding 23 and secondary windings 21.

The transformer 20 has the following relationships between the primary and secondary voltages, as illustrated in FIG. 2.

$$V_{pri} = \frac{E_{dc} n_p N_{sc}}{n_{sc}}$$

$$V_{pri} = \frac{E_{out} n_p}{n_{sc}}$$

$$E_{dc} = \frac{V_{pri} n_{sc}}{n_p N_{sc}} = \frac{E_{out}}{N_{sc}}$$

where $V_{pri}$ is the primary voltage across the primary winding 23

$E_{dc}$ is the rectified secondary voltage across one secondary winding 21

$n_p$ is number of primary turns $N_{sc}$ is the number of secondary magnetic circuits or cores $n_{sc}$ is the number of secondary turns per magnetic circuit or core $E_{out}$ is the output voltage of the transformer A practical system might require twenty secondary cores each with an internal diameter of around 100 mm and height of 25 mm, which would require a structure 500 mm long. Winding only six turns through such an assembly would be a difficult and tedious task. Furthermore, controlling a wire that may require a sufficient cross-section to handle high frequency current of up to 150 A while being positioned carefully for voltage hold off of up to 25 kV would be difficult.

This invention provides a practical construction arrangement that overcomes the difficulties associated with solving this problem.

With high frequency currents only a surface of a conductor is fully utilised for current flow. Skin depth, that is a depth where a current is reduced to only 37% of a surface value, is used to describe this well-known effect. For copper, one of the best practical electrical conductors, skin depth is approximately given by the equation:

$$\text{skin_depth_in_cm} = \frac{6.62}{\sqrt{\text{frequency_in_Hz}}}$$

Thus for say 5000 Hz the skin depth is only 0.09 cm. Thus high current conductors require a large area even at quite "low" high frequencies.

Known Litz wire has many strands of thin conductors insulated from each other bunched and wound in a manner which can assist in such applications. However Litz wire is expensive, complex, and difficult to make connections to.

Two more practical but effective materials are flat strip conductors of thickness comparable to, but slightly greater than, the skin depth and tubes with a wall thickness comparable to, but slightly greater than, the skin depth. Optionally, the conducting members comprise a combination of tubes connected in parallel with a wall thickness comparable to, but slightly greater than, a skin depth of the electric current carried thereby at an operating frequency of the transformer.

All thin wires, whether Litz or conventional, tend to lack rigidity and fall or sag under the effect of gravity or move under the effect of other forces. Thus precise location of such electrical conductors to control their position for high voltage insulation can be a problem.

In the present invention multi-turn primary wiring is realised by a mechanical arrangement using relatively rigid strips and tubes. A feature is the use of standard established low cost material forms.

Figure 3:
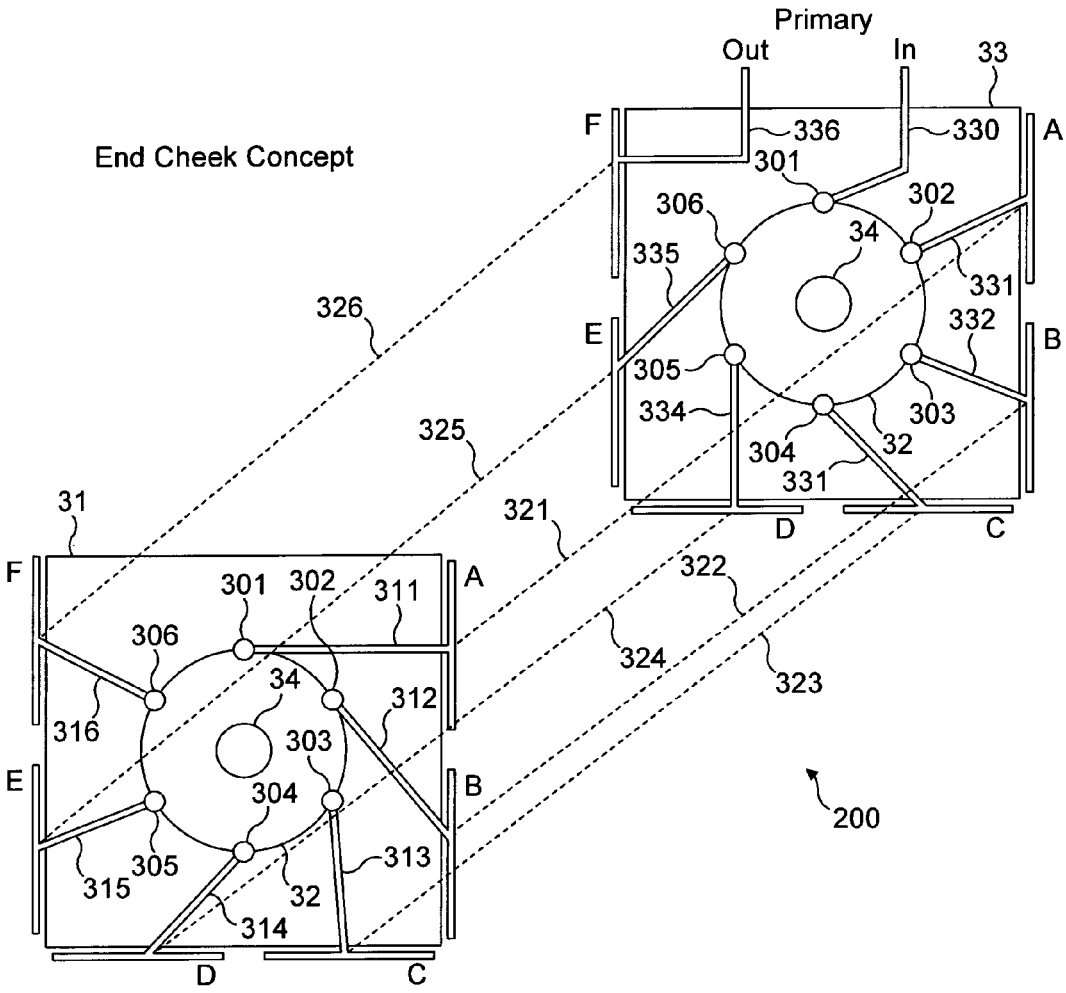
FIG. 3 shows end cheeks of a second embodiment of a transformer according to the invention.
Figure 4A:
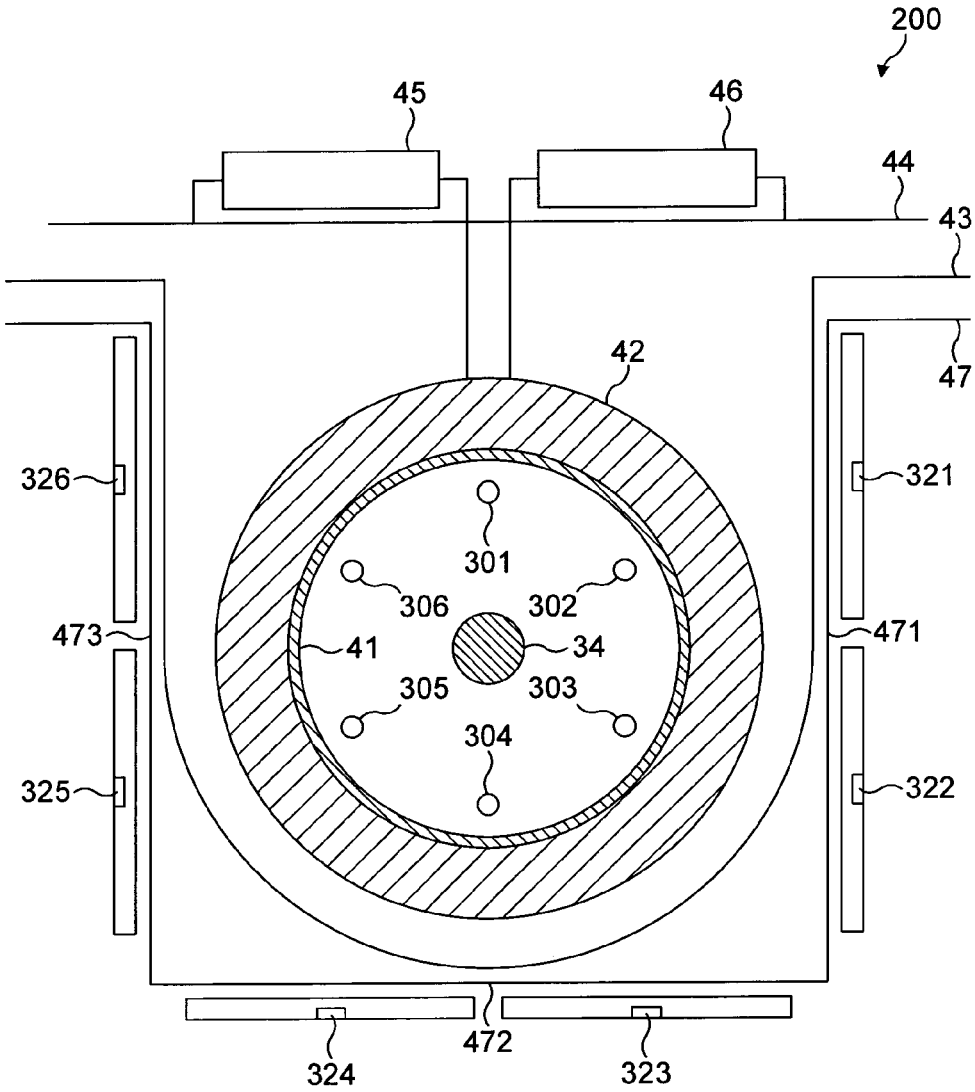
FIG. 4*a* is an end view of the embodiment of FIG. 3.

Referring to FIG. 3, which shows opposed end cheeks of a transformer 200 according to an embodiment of the present invention and to the end view of FIG. 4*a*, a group of tubes or rods 301-306 are used for centre conductors, evenly spaced on a circumference of a pitch circle 32 and located axially within a group of secondary toroids 42. A return electrical path is formed for these tubes or rods 301-306 by strip lines 321-326 on three outer faces of a trough-like structure 47 containing the secondary toroids 42. The conductors of these printed circuit boards are somewhat thicker than a skin depth of the electric current carried thereby at an operating frequency of the transformer. This is to ensure that stray coupling outside the transformer to other collocated components is minimized, particularly to other like transformers.

FIG. 3 shows conceptually a connection method that with suitable use of opposed end cheeks 31, 33 provides necessary connections.

Referring to FIGS. 3 and 4*a*, outer faces of three sides 471, 472, 473 of the trough 47, and of the opposed end cheeks 31, 33 can be realised using printed circuit boards A-F or chemical machining techniques. Printed circuit board (PCB) material can be manufactured with copper that can be built up to any required thickness, so that the skin depth issue is not a problem.

Thus, tubes or rods and strip lines on sides of a trough-like structure 47 containing coaxial secondary closed magnetic circuits 42 are connected in series to form the primary winding.

An input strip line 330 on a first end cheek 33 connects a primary input terminal to a first end of a first tube or rod 301, only the ends of which are shown in the interests of greater clarity of the drawing.

A second end of the first rod or tube 301 is connected by a first cheek strip line 311 on the second end cheek 31 to a first end of a first strip line 321 on an outer face of a first side 471 of the trough-like structure 47 shown in FIG. 4*a*. A second end of the first strip line 321 is connected by a first cheek strip line 331 on the first cheek 33 to a first end of a second rod or tube 302.

A second end of the second rod or tube 302 is connected by a second cheek strip line 312 on the second end cheek 31 to a first end of a second strip line 322 on the outer face of the first side 471 of the trough-like structure 47. A second end of the second strip line 322 is connected by a second cheek strip line 332 on the first cheek 33 to a first end of a third rod or tube 303.

A second end of the third rod or tube 303 is connected by a third cheek strip line 313 on the second end cheek 31 to a first end of a third strip line 323 on an outer face of a second side 472, orthogonal to the first side 471, of the trough-like structure 47. A second end of the third strip line 323 is connected by a third cheek strip line 333 on the first cheek 33 to a first end of a fourth rod or tube 304.

A second end of the fourth rod or tube 304 is connected by a fourth cheek strip line 314 on the second end cheek 31 to a first end of a fourth strip line 324 on the outer face of the second side 472 of the trough-like structure 47. A second end of the fourth strip line 324 is connected by a fourth cheek strip line 334 on the first cheek 33 to a first end of a fifth rod or tube 305.

A second end of the fifth rod or tube 305 is connected by a fifth cheek strip line 315 on the second end cheek 31 to a first end of a fifth strip line 325 on an outer face of a third side 473, orthogonal to the second side 472 and parallel to the first side 471 of the trough-like structure 47. A second end of the fifth strip line 325 is connected by a fifth cheek strip line 335 on the first cheek 33 to a first end of a sixth rod or tube 306.

A second end of the sixth rod or tube 306 is connected by a sixth cheek strip line 316 on the second end cheek 31 to a first end of a sixth strip line 326 on the outer face of the third side 473 of the trough-like structure 47. A second end of the sixth strip line 326 is connected by an output strip line 336 on the first cheek 33 to a primary output terminal.

To ease manufacture it is desirable that the turns of the primary winding are grouped in multiples of three, so that all the printed boards on the outer faces of the three sides 471, 472, 473 of the trough 47 are identical.

The strip lines 321 through 326 are somewhat thicker than a skin depth so that coupling outside the transformer, particularly to co-located transformers, is minimised. Alternatively a conductive sheet thicker than a skin depth can be placed between co-located transformers.

Figure 4B:
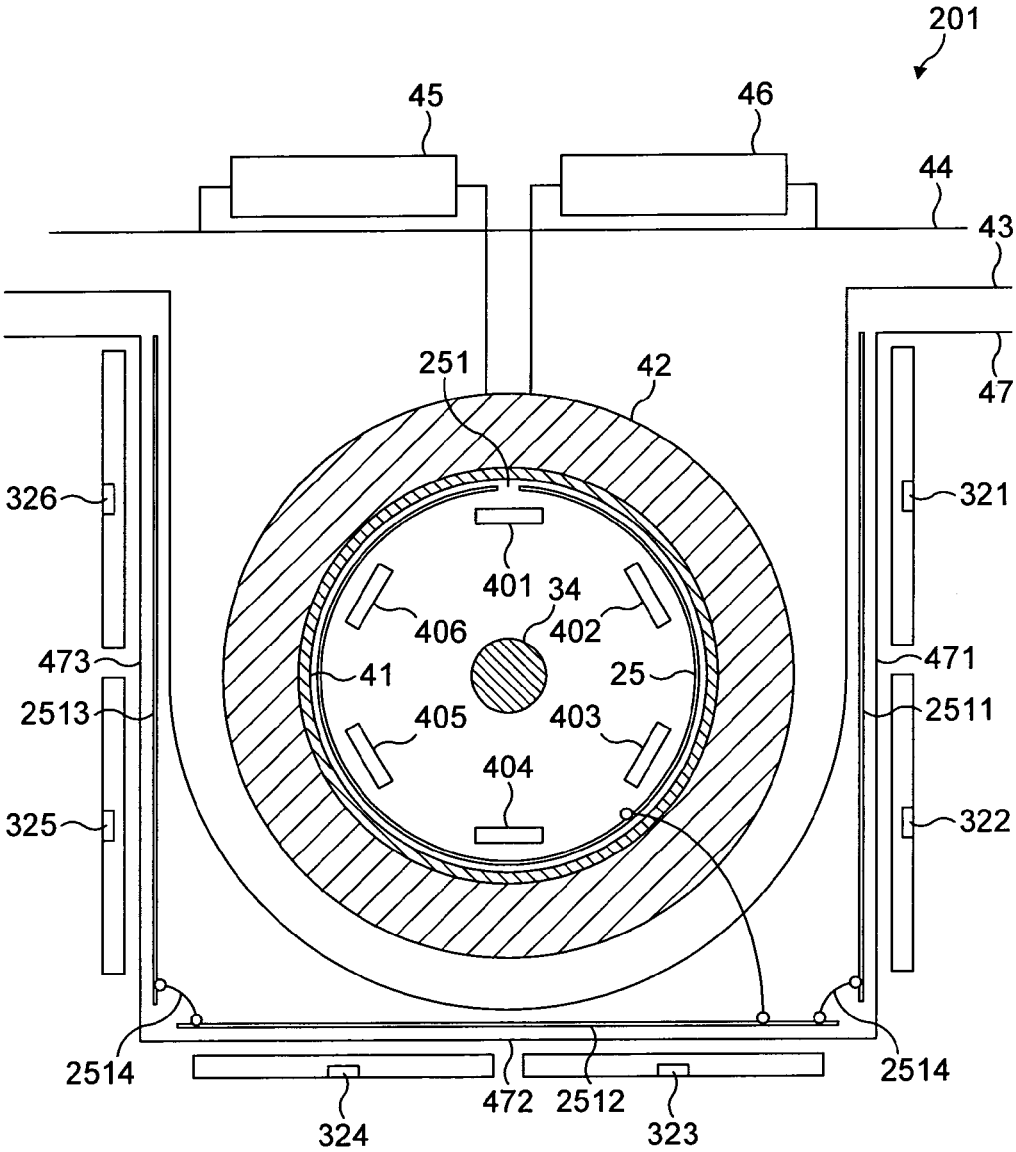
FIG. 4*b* is an end view of a third embodiment of the invention.

FIG. 4*a* shows a simplified end view of the assembled transformer 200. An inner insulating tube 41 is used to locate the secondary toroids 42 and provide voltage hold off for the tubes or rods 301-306 of the primary turns. As shown in FIG. 4*b*, if an electrostatic screen between primary and secondary is required, this can be provided by a thin-walled metallic sleeve 25 on the inner face of the inner insulating sleeve 41 with a longitudinal slit 251 to minimise eddy currents. A single sheet 43 of suitable insulating material located between the toroids 42 and the inner walls of the enclosure 47 can provide an outer insulation wrap. This material can be simply formed or bent into position to provide a required high voltage clearance and high voltage tracking distance. The fourth side of the trough houses a more conventional PCB 44 on which, for example, any required rectifier diodes and filter components 45, 46 are installed.

FIG. 4*b* shows an alternative embodiment 201 of a transformer in which centre conductors are flat strips 401-406 instead of rods or tubes 301-306 as in the previously described embodiment 200. FIG. 4*b* also shows the electrostatic screen 25 which may be provided as described above if such an option is required.

However, to be fully effective the screening between the primary and secondary also needs to shield the return strips 321 through 326 from the secondary 42. FIG. 4*b* shows an additional three screens 2511, 2512 and 2513. These may be thin copper sheets (20 μM thickness would be suitable) and are connected by links 2514 and 2515. The screen 25 is electrically linked to the screen assembly 2511, 2512 and 2513 by a wire link 2517 at the low voltage end of the transformer.

The screens 2511, 2512 and 2513 may alternatively be realised using printed circuit boards with, for example, 70 μm thick copper conductors (2 oz/ft$^2$) on 1.6 mm thick glass fibre reinforced polymer (GFRP) single-sided copper printed circuit board material (such as FR4) to replace the enclosure 47. The inner face of copper is used as the screen while the outer face of the printed circuit board material may have the return strips 321 through 326 bonded/etched into/onto the printed circuit board material, thereby forming double-sided printed circuit boards.

This adaptation can be used with either of the arrangements of the transformer shown in FIG. 4*a* or 4*b*.

Any high power transformer requires cooling and in some embodiments there is provided an inner tube 34, coaxial with the secondary toroids 42, for coolant distribution, the inner tube 34 being supplied with suitable bleed holes, not shown, to direct the coolant towards respective secondary toroids 42. The nature of the primary winding 23 with small radial gaps comprising spaces between the rods 301 to 306 or the strips 401 to 406 means the coolant is readily directed onto the toroids 42 without the structure of the primary winding 23 causing a major barrier as would be the case with a conventional winding.

Referring to FIGS. 4*a* and 4*b*, the trough structure 47 minimises coupling between an inside and outside of the transformer 200, 201. The trough structure 47 also reduces leakage inductance to a minimum allowed by required spacing for voltage and current input and output requirements of the transformer. This low coupling characteristic is desirable in a 3-phase application of the apparatus.

For applications with a 3-phase inverter system, three individual and isolated transformer assemblies of the type described above are provided. Such a system may be as disclosed in GB 0711094.3, in which the primary windings are delta connected and fed from the 3-phase inverter.

Figure 5:
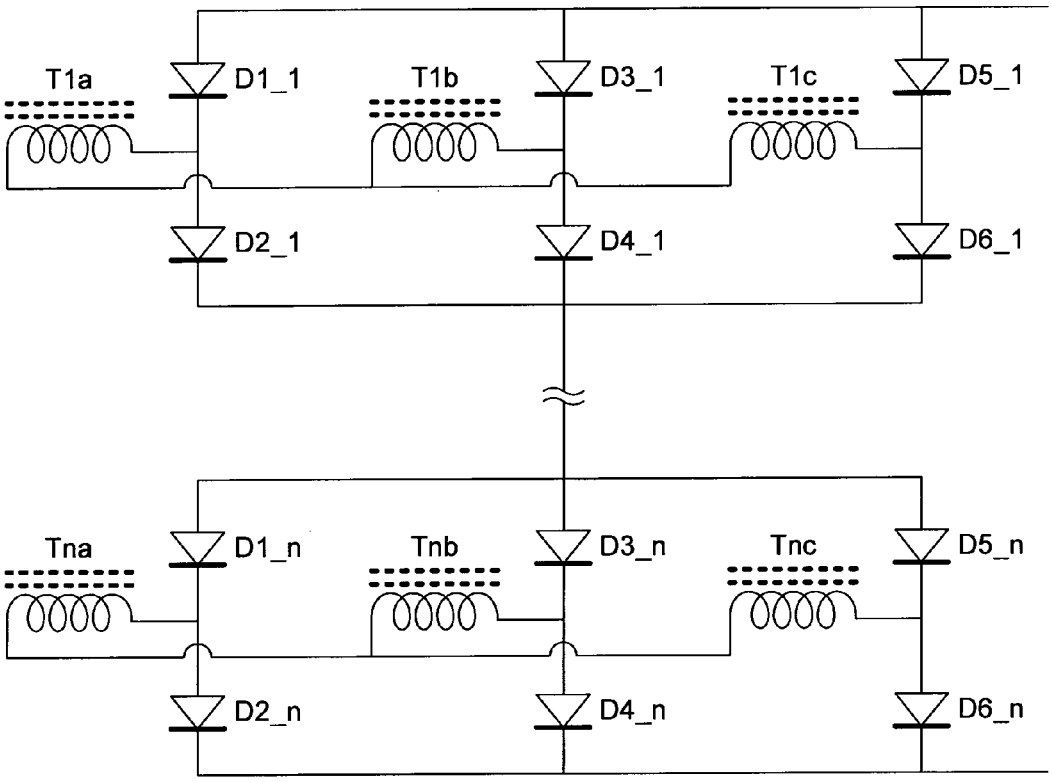
FIG. 5 is a circuit diagram showing the interconnection of the secondary windings in a second aspect of the invention.

The secondaries are connected as illustrated in FIG. 5. In this arrangement each of the secondary windings of an individual transformer, for example T1*a*, T1*b* and T1*c*, are star connected and fed to a standard six pulse rectifier. Each of the individual rectifier circuits could if required have a suitable ripple reduction filter capacitor, inductor, or combination of both as detailed in GB 0711094.3.

The use of a multiple rectifier circuit approach minimises effects of stray capacitance and is desirable as disclosed in GB 0706197.1.

It will be noted that inter-phase coupling between the individual phases is minimized in this arrangement for use with a modified pulse width modulated three phase signal source.

Figure 6:
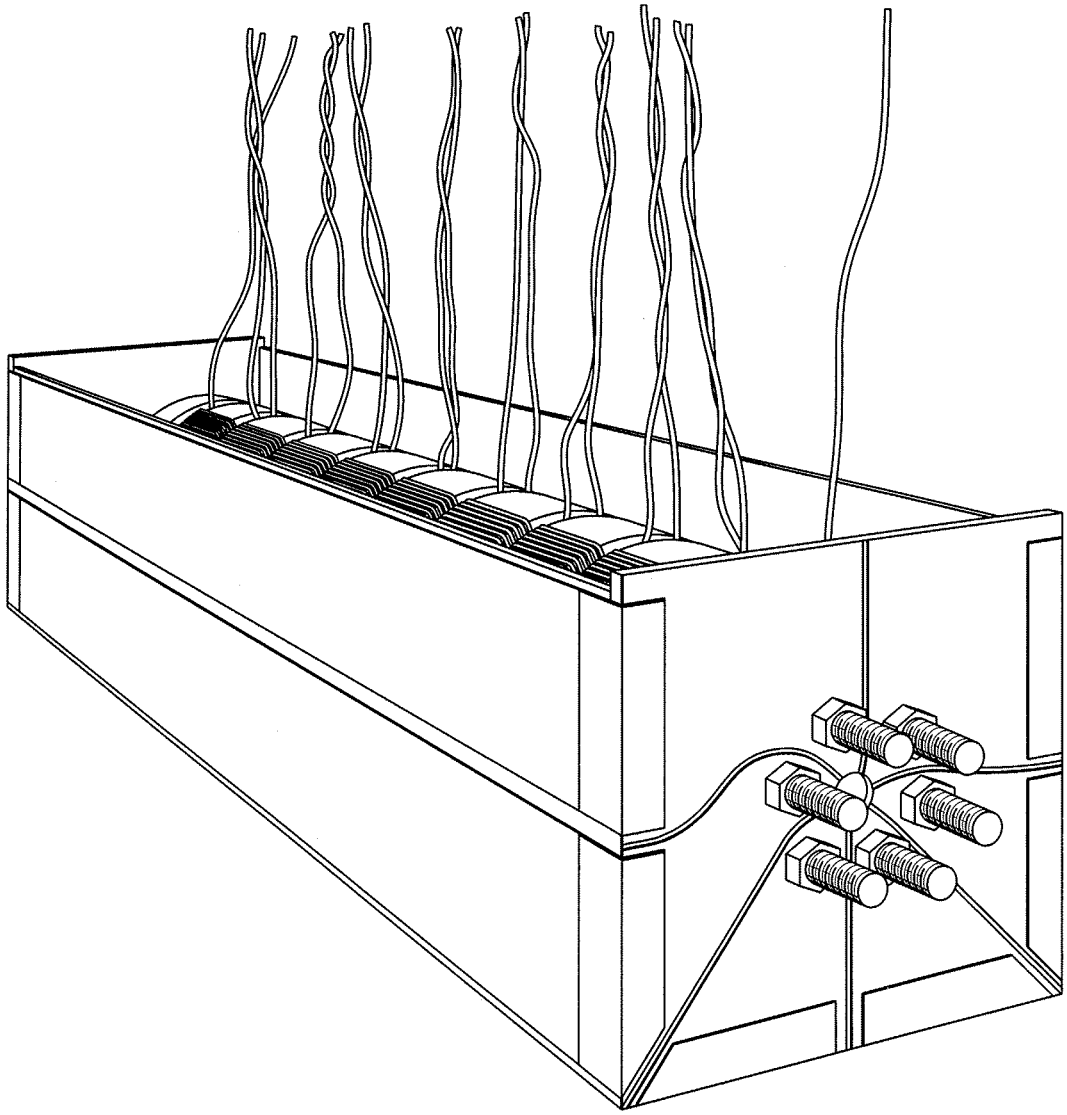
FIG. 6 is a photograph of a model of a transformer according to the invention.

A photograph of a scale model of a transformer according to the invention (without rectifiers) is shown in FIG. 6.

Thus FIG. 6 shows a scale model transformer which uses ten TX36/23/15 (4330-030-4416) cores in 3C90 material each wound with 114 turns of 0.5 mm en. Cu wire. The primary is made from six central 4 BA brass rods spaced apart cylindrically from each other and three outer PCB's each with two return conductors. End plates are arranged so that the six central rods are connected in series via the three outer PCB's to form a six turn primary. The nominal ratio is 114/6=19. All the secondary coils are connected in series for the purpose of checking the various parameters. Using a Megger B131 bridge at 1 kHz the full secondary winding had an inductance of 525 mH and the 6 turn primary winding an inductance of 1.459 mH. The ratio from these values was 18.98—reasonably close to the nominal ratio. With a short circuit on the primary winding, the leakage inductance was 682 μH with a Q of 155.

| Core No | L (mH) | Q |
|---|---|---|
| 1 | 57.0 | 30.4 |
| 2 | 57.3 | 31.3 |
| 3 | 57.7 | 34.6 |
| 4 | 57.3 | 32.6 |
| 5 | 56.4 | 33.1 |
| 6 | 58.2 | 32.0 |
| 7 | 60.5 | 31.4 |
| 8 | 59.7 | 30.4 |
| 9 | 61.3 | 29.5 |
| 10 | 58.1 | 37 |

Further measurements were made with a Fluke PM6306A bridge of the shunt inductance on the parallel model Lp and Rp, the winding not being measured being open circuit at both ends.

| Frequency | Secondary | | Primary | |
|---|---|---|---|---|
| kHz | Lp (mH) | Rp (Mohms) | Lp (mH) | Rp (Kohms) |
| 1.0 | 518.8 | 0.225 | 1.52 | 0.314 |
| 3.0 | 501.2 | 1.360 | 1.52 | 1.088 |
| 10.0 | 499.2 | 6.600 | 1.53 | 4.000 |
| 30.0 | 562.0 | 15.000 | 1.83 | 13.160 |
| 60.0 | 1130.0 | 14.700 | 20.1 | 15.000 |
| 72.2 (61.9)* | 0.4° | 11.000 | 1.2° | 16.300 |

*These readings were taken at a parallel resonance point. The number in parenthesis is for the primary values. The secondary referred capacitance based upon the secondary measurement is around 9pF. The values 0.4° and 1.2° in the above table are the phase angle, nominally zero, implying a resonance with the stray capacitance when Rp also reaches a maximum. When a measurement was made the other winding was left floating. This will have reduced the effective capacitance measured and also resulted in different primary referred values due to the different geometries of the two structures.

The leakage inductance was checked at the secondary winding with the primary winding short circuited and floating. The bridge was set to use Ls and Rs series model.

| Frequency | Ls (μH) | Rs (ohms) |
|---|---|---|
| 1.0k | 684 | 27.6 |
| 3.0k | 660 | 27.6 |
| 10.0k | 652 | 28.4 |
| 30k | 637 | 32.0 |
| 60k | 624 | 37.2 |
| 100k | 620 | 45.0 |

Thus the model established the basic soundness of the principle of the construction technique.

The invention claimed is:

1. A transformer comprising: an enclosure; a secondary winding including a plurality of coaxially arranged toroidal closed magnetic circuits connected in series and located within the enclosure; and a primary winding comprising a plurality of turns including electrically conducting members passing axially through the toroidal closed magnetic circuits, respective ones of the plurality of the electrically conducting members being connected by respective electrically conducting strip lines passing along walls of the enclosure to form a continuous electrical conductor as the primary winding.

2. A transformer as claimed in claim 1, wherein the electrically conducting members are mutually spaced apart such that cross-sections of the conducting members lie substantially on a circumference of a circle on a transverse cross-section of the enclosure.

3. A transformer as claimed in claim 1, wherein the electrically conducting members are at least one of tubes, rods and strip conductors.

4. A transformer as claimed in claim 3, wherein the electrically conducting members are tubes with a wall thickness comparable to a skin depth of the electric current carried thereby at an operating frequency of the transformer.

5. A transformer as claimed in claim 3, wherein the electrically conducting members are flat strip conductors having a thickness comparable to a skin depth of the electric current carried thereby at an operating frequency of the transformer.

6. A transformer as claimed in claim 1, wherein the electrically conducting members comprise a combination of electrically conducting members connected in parallel, each conducting member with a wall thickness comparable to a skin depth of the electric current carried thereby at an operating frequency of the transformer.

7. A transformer as claimed in claim 1, wherein the electrically conducting strip lines are formed in printed circuit boards located on outer faces of walls of the enclosure.

8. A transformer as claimed in claim 1, wherein the enclosure has a substantially rectilinear transverse cross-section and the walls of the enclosure parallel to a longitudinal axis of the enclosure are substantially planar.

9. A transformer as claimed in claim 8, wherein the electrically conducting strip lines are located on first, second and third walls of the substantially planar walls and have a thickness greater than a skin depth at an operating frequency of the transformer.

10. A transformer as claimed in claim 8, wherein a fourth substantially planar wall comprises a printed circuit board for rectifying components.

11. A transformer as claimed in claim 1, comprising an insulating tube on which the secondary toroidal closed magnetic circuit means are located arranged to provide voltage hold off for the electrically conducting members passing axially through the toridal closed magnetic circuits.

12. A transformer as claimed in claim 1, comprising a coolant distributor.

13. A transformer as claimed in claim 12, wherein the coolant distributor comprises a tube, coaxial with, and of smaller diameter than, core apertures of the toroidal closed magnetic circuits, the tube being supplied with bleed hole apertures to direct the coolant towards respective secondary toroids.

14. A transformer as claimed in claim 1 comprising an electrostatic screen between the primary winding means and secondary winding means.

15. A transformer as claimed in claim 14, wherein the electrostatic screen includes a thin-walled metallic sleeve located between the primary winding and the secondary winding.

16. A transformer as claimed in claim 15, wherein the thin-walled metallic sleeve comprises a longitudinal slit to minimise eddy currents in the thin-walled metallic sleeve.

17. A transformer as claimed in claim 1, comprising an electrically insulating sheet located between the toroidal closed magnetic circuits and inner walls of the enclosure to provide high voltage insulation and minimise a risk of high voltage tracking across a surface of the insulator.

18. A transformer as claimed in claim 1, wherein the individual secondary toroidal closed magnetic circuits are interconnected such that each secondary toroidal closed magnetic circuit of the transformer is star connected and provides an input to a two pulse rectifier.

19. A three-phase inverter system, comprising three individual and isolated transformers as claimed in claim 1 wherein the primary windings of the transformers are delta connected and arranged to be fed from a three-phase inverter.

20. A three-phase inverter system as claimed in claim 19, wherein the secondary toroidal closed magnetic circuits of the three individual and isolated transformers are interconnected such that each secondary toroidal closed magnetic circuit of a transformer is star connected and provides an input to a six pulse rectifier.

* * * * *